United States Patent [19]

Bucy

[11] 4,412,468

[45] Nov. 1, 1983

[54] TABLE MOUNTED STOP GAUGE FOR A CUTOFF SAW

[76] Inventor: James D. Bucy, 625 S. Fourth St., Murray, Ky. 42071

[21] Appl. No.: 280,694

[22] Filed: Jul. 6, 1981

[51] Int. Cl.[3] ..... B27B 27/08

[52] U.S. Cl. ..... 83/468; 269/303; 269/315; 269/319

[58] Field of Search ..... 83/467, 468, 212, 268, 83/391, 471.3; 269/303, 304, 315, 319

[56] References Cited

U.S. PATENT DOCUMENTS

| | | | |
|---|---|---|---|
| 637,214 | 11/1899 | Pangborn | 269/319 |
| 869,309 | 10/1907 | Kramer | 269/315 |
| 957,779 | 5/1910 | Leaver, Jr. | 269/303 |
| 1,574,445 | 2/1926 | Robinson | 83/468 |
| 2,435,382 | 2/1948 | Caskey | 83/467 X |
| 3,249,135 | 5/1966 | Leaver | 269/315 |

*Primary Examiner*—Donald R. Schran
*Attorney, Agent, or Firm*—Maurice L. Miller, Jr.

[57] ABSTRACT

A saw gauge for quickly and accurately measuring lengths of boards to be cut with a cross-cut saw is disclosed. The gauge includes a series of two or more bar segments having a flat base portion adapted for mounting on a cutting table in line with a guideway or fence also mounted thereon and a plurality of raised ribs of predetermined width projecting upwardly from the base portion and being spaced apart by channels of predetermined width. An elongated pivot pin extends the length of the segments behind all of the ribs in each segment except an end one of the ribs, which extends rearwardly behind the remaining ones of the ribs in each segment and contains a hole therein through which the pin projects for support. An elongated stop arm is pivotally attached to the pin between successive end ribs through which the pin projects and is tiltable in a vertical arc from a storage position projecting away from the channels between the ribs to a position of use projecting through and beyond a channel in which the arc is aligned, the arm being slidable along the pin between successive end ribs so as to align the arc with any one of the channels in a single bar segment.

7 Claims, 9 Drawing Figures

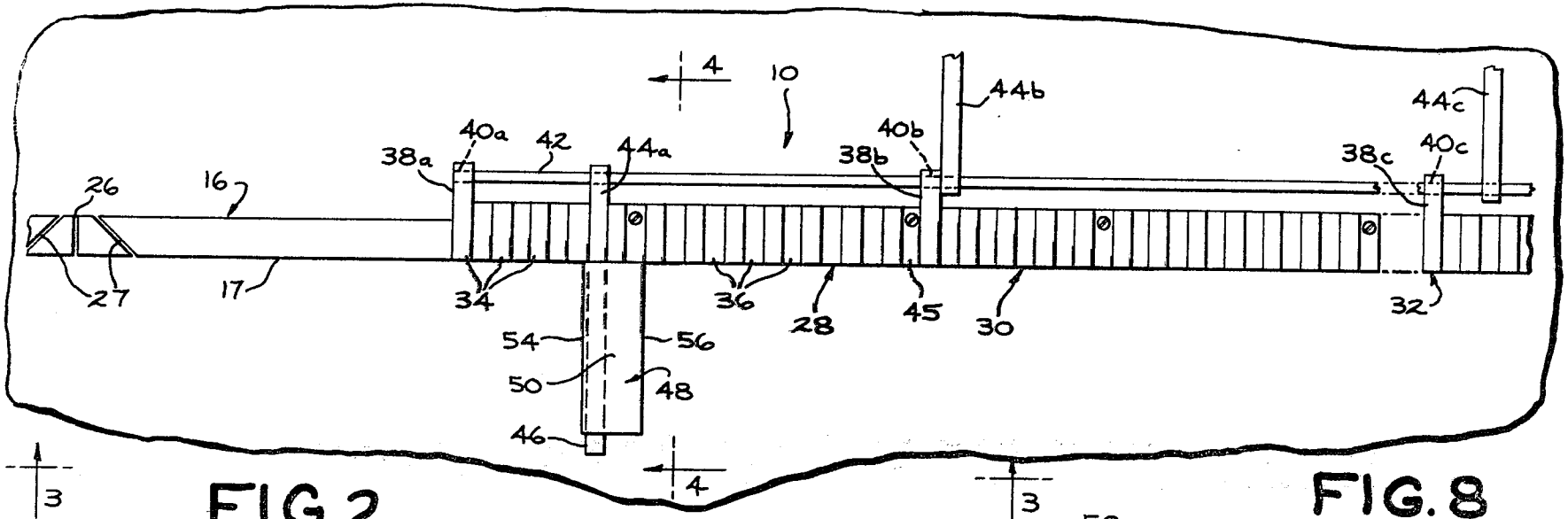
FIG. 2
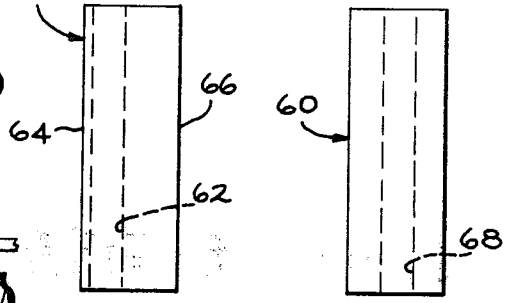
FIG. 8
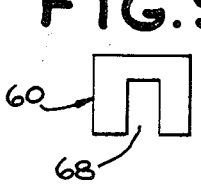
FIG. 9
FIG. 6
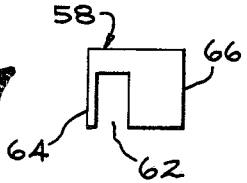
FIG. 7
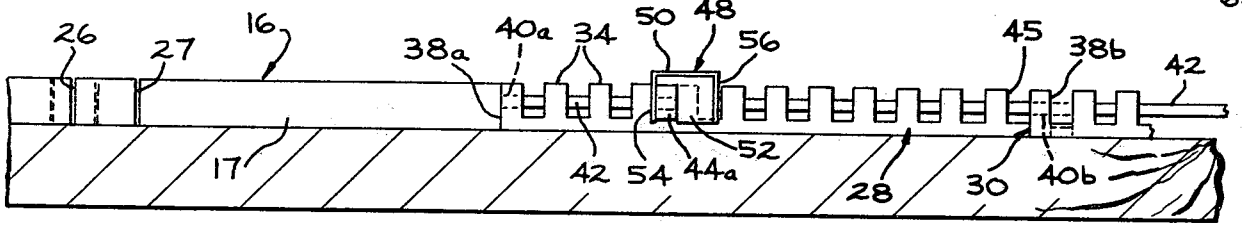
FIG. 3

TABLE MOUNTED STOP GAUGE FOR A CUTOFF SAW

BACKGROUND OF THE INVENTION

This invention relates to adjustable stop gauges mounted on the cutting tables of a cross-cut saw for quickly and accurately positioning of boards or other materials thereon for cutting of such boards or materials to predetermined lengths.

Generally speaking, such devices have long been known and used in the prior art. See, for example, those disclosed in U.S. Pat. No. 869,309 issued to W. A. Kramer on Oct. 29, 1907 and U.S. Pat. No. 2,435,382 issued to H. T. Caskey on Feb. 3, 1948.

Kramer teaches the use of an elongated bar containing threads thereon which are interrupted on opposite sides of the bar by flat faces. A series of elongated arms are mounted on the threaded bar and can be tilted downward into a channel. A spring located on a portion of the arm bears against a guard member when the arm is tilted downward into the channel which keeps the free end of the arm away from the wall of the channel in interrupting relation to the end of a board guided along a ruled segment in front of the channel. The arms have collars mounted upon the bar which allow the stops to be moved along the bar to selected positions when tilted upwardly out of line with the channel. The threads of the bar hold the stop arms securely in position when the arms are tilted downwardly into the channel for use.

Caskey teaches an adjustable saw gauge having an elongated bar or pivot pin mounted along and over a cutting table and a series of three arms or brackets containing wheels on the free ends thereof which are referred to as stop rings. The arms are slidable along the pin to the desired position relative to the saw blade and are secured in the desired position by a set screw.

One difficutly with these prior art saw gauges is that they are bulky and complex in their construction. The gauge of Kramer does not readily lend itself to being segmented so that additional segments may be added to segments already in use where it is desired to cut boards to widely different lengths. The stop gauge of Caskey does not permit a board to be brought onto the cutting table by sliding it along a fence but, rather, requires that the board to be cut to length first be roughly positioned in alignment with the blade by hand, then pushed rearward against a fence, and thereafter moved slightly to one side or the other to engage a stop. Also Caskey does not teach a gauge device which can be used to measure more than three specific board lengths at a given setting of the stops. As the stops are moved, painstaking measurements must again be made.

My invention substantially overcomes these and other prior art difficulties.

SUMMARY OF THE INVENTION

Briefly, it is an object of my invention to provide a saw gauge adapted for use with a cutoff saw of the type which includes a cutting table, an elongated fence mounted on the table, and a cutting blade adapted to cut through the fence and a board positioned on the table against the fence. The saw gauge includes a plurality of bar segments, each being defined by a base portion adapted to mount flush on the table in line with the fence and a plurality of raised ribs. The ribs project upwardly from the base and are spaced from one another by channels. An elongated pivot pin is provided which extends parallel to the bar segments behind and spaced from the ribs. Means attached to the bar segments is provided for supporting the pin. At least one elongated stop arm is pivotally connected on one end thereof to the pin and is tiltable through a vertical arc from a storage position projecting away from the channels to a position of use projecting through and beyond the front of one of the chanels with which the arc is aligned. The arm is slidable along the pin for selective alignment of the arc with any one of the channels.

This and other objects of my invention will become apparent to those skilled in the art from the following detailed description and attached drawings upon which, by way of example, only one preferred embodiment of my invention is illustrated.

BRIEF DESCRIPTION OF THE DRAWINGS

FIG. 2 shows a plan view of the saw gauge of FIG. 1.

FIG. 3 shows a front elevation view of the saw gauge of FIGS. 1–2.

FIGS. 6–7 show plan and end elevation views, respectively, of an alternative gauge block construction which may be used in place of the gauge block of FIGS. 1–5.

FIGS. 8–9 show plan and end elevation views, respectively, of a gauge block constructed according to the example of FIGS. 6–7, but having different dimensions for providing different incremental measurements.

DESCRIPTION OF THE PREFERRED EMBODIMENT

Figure 1:
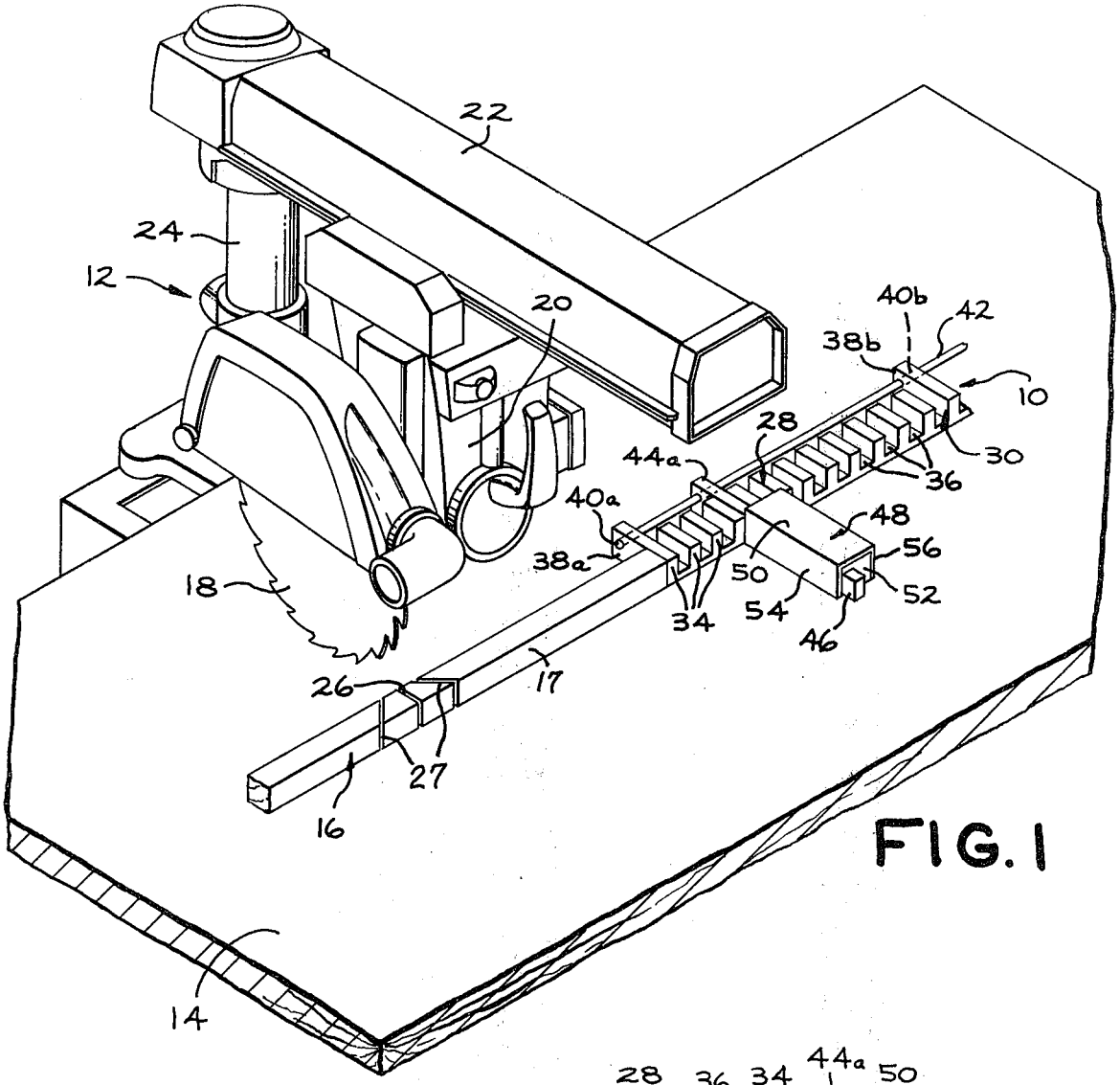
FIG. 1 shows a perspective view of a saw gauge as used with a conventional rotary power saw for accurately measuring the lengths of materials to be cut, thus illustrating one preferred embodiment of my invention.
Figure 5:
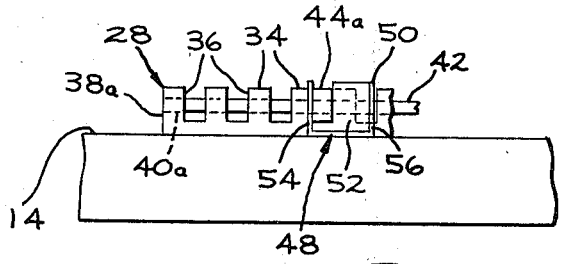
FIG. 5 shows a front elevation view of a fragment of the saw gauge of FIGS. 1–4 but with a gauge block element thereof turned over.

Referring now to the drawing figures, there is shown, in one preferred embodiment of my invention, a gauge 10 for quickly and accurately measuring to predetermined lengths, boards and other materials, not shown, prior to cutting the same to such lengths with a power saw 12.

The saw 12 of the present example is of the usual, well known type and includes a flat, rectangular cutting table 14, across a portion of which is mounted an elongated strip of wood having rectangualr cross-section which is commonly known as a fence 16. The forward face 17 of the fence 16 provides a straight guideway against which an edge of a board to be cut is placed to correctly align the board for cross-cutting with a blade 18. The blade 18 and its drive motor 20 are suspended over the table 14 from an arm 22 which is attached on a rear end portion thereof to a vertical support member 24. The blade 18 is thus positioned to cut across and through a slot 26 in the fence 16 along a cutting line which lies in the horizontal plane and is perpendicular to the forward face 17. Boards cut by the saw 12 may thus be cut off a right angles to their length. Such prior art saws are also usually adapted to permit pivoting the blade 18 and drive motor 20 about a vertical axis through their point of suspension from the arm 22 so that boards may be cut off along horizontally extending cutting lines which are diagonal with respect to the forward face 17, as through diagonally extending slots 27 in the fence 16.

Now, in accordance with the present example of my invention, the gauge 10 includes a series of three bar segments 28, 30, 32 of substantially identical construction and dimensions, by reason of which only the segment 28 will be explained in complete detail. The guage 10 of the present example may be employed using as few as two of such segments or as many as needed depending upon the lengths of each, how far to one side of the cutting line of the blade 18 they are to be positioned, and the lengths of wood to be measured and cut. I prefer to make each of the segments 28, 30, 32 one foot in length with an accuracy of at least within ±16 inch although different lengths may be selected as desired. Also, while I find such accuracy sufficient for most wood working applications, a greater or lesser accuracy of construction may be used as necessary.

Referring now specifically to the construction of the bar segment 28, the same may be formed from a single block of wood, metal, plastic or other suitable material and contains a flat bottom surface adapted to mount flush on the top of the table 14 and a series of twelve equally spaced parallel ribs 34 of rectangular cross-section. Each of the ribs 34 are preferably one-half inch in width and are spaced apart by channels 36 which are also one-half inch in width and of rectangular cross-section. The first of the ribs 34 located on the extreme lefthand side of the segment 28 as viewed in FIGS. 1–3, contains a sidewall 38*a* which abuts the righthand end of the fence 16 so that the front face of the segment 28 is in line with the forward face 17 (see particularly FIG. 2). Also, the first rib, as partially defined by the sidewall 38*a*, projects rearwardly beyond the rear end of the remaining ones of the ribs 34 of the segment 28 and contains a cylindrical hollow shaft 40*a* therethrough into which one end portion of an elongated cylindrically-shaped pin 42 projects. The pin 42 extends through a similar shaft 40*b* in the extreme lefthand rib of the segment 30 and through a shaft 40*c* in the extreme lefthand rib of the segment 32 and so on across as many additional bar segments as may be in use. I recommend that the overall height of the segments 28, 30, 32, etc. be approximately the same height as the fence 16 (See FIG. 3), although this is by no means necessary or essential. There should be a sufficient depth of material between the bottom surface of each of the channels 36 and the bottom surface of the segments 28, 30, 32, etc. to assure rigidity and strength of the segment, preferably at least ¼ inch where the material is oak, although a suitable minimum depth will depend upon the type of wood, plastic, metal or other material from which the segment is made.

Figure 4:
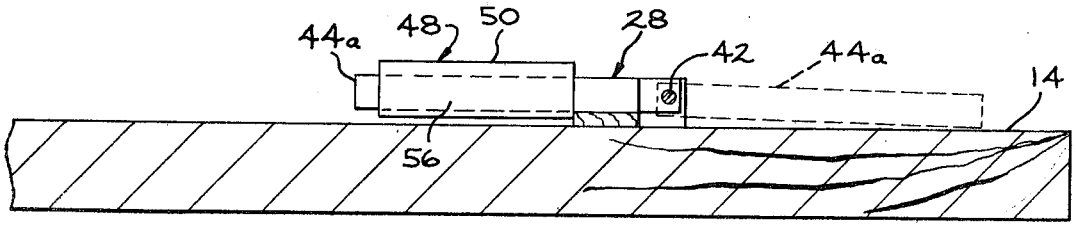
FIG. 4 shows a cross-sectional elevation view of the saw gauge of FIGS. 1–3 as viewed along cross-section lines 4—4 of FIG. 2.

An elongated stop arm 44*a*, which may be constructed of solid or three-sided aluminum channel material, for example, is pivotally connected on one end portion thereof to the pin 42 so that it may be tilted through a semi-circle in the vertical plane to a forward projecting position lying in one of the channels 36 (FIGS. 1–5) or tilted to lie upon the table 14 and project rearwardly behind the segment 28 when not in use (See the dashed lines 44*a* in FIG. 4 and the position of the arms 44*b, c* of the segments 30, 32 in FIG. 2). The width of the arm 44*a* should be just slightly less than ½ inch to enable it to fall smoothly but snugly into each of the channels 36 and not jiggle from side to side in the channel when impacted. The arms 44*a* can be adjusted along a portion of the length of the pin 42 lying between the ribs 34 on the extreme lefthand sides of the segments 28, 30 so as to lie within any desired one of the channels 36 of the segment 28. In the present example, the arm 44*a* lies within the fourth one of the channels 36 from the left side 38*a* of the segment 28 and projects forwardly beyond the front face of the segment 28 and fence 16 to form a stop against which one end of a board may be placed for cutting the same to length with the blade 18. Since, in the present example, the sidewall 38*a* is precisely 11½ inches away from a plane containing the face of saw 18 or the centerline of the cutting groove 26, the lefthand side 46 of the arm 44*a* lying in the fourth channel 36 is an additional 3½ inches to the left of the sidewall 38*a*. Accordingly, the distance between the line of cut through the slot 26 and the left side 46 of the stop arm 44*a* is precisely 15 inches. Thus, by using the arm 44*a* as a stop, boards may be cut by the blade 18 to lengths of from 12–23 inches in increments of one inch. To cut such boards to longer lengths requires that the arm 44*a* be tilted to its storage position behind the segment 28 and that either the stop arm 44*b* or 44*c* be employed. The stop arms 44*b, c* are identical to the construction of the stop arm 44*a* except that they can be adjusted to lie within any desired one of the channels 36 located on the segments 30 and 32, respectively. Consequently, by using the stop arm 44*b*, boards can be cut in lengths of from 24–35 inches in one inch increments, and by placing both of the stop arms 44*a, b* in their storage positions behind the segments 38, 30, the arm 44*c* can be employed as a stop to cut boards to lengths of from 36–47 inches in increments of one inch. As previously mentioned, additional bar segments with associated stop arms can be added in series with the segments 28, 30, 32 to cut boards to greater lengths in one inch increments.

An additional feature of my invention permits the measuring and cutting of boards to the desired length in lesser than one inch increments through the use of a series of gauge blocks such as the block 48, for example. The block 48 contains a casing 50 which may be constructed of three-sided aluminum channel 1/16 inch thick. Within the casing 50 is disposed a wood filler block 52 through which a hollow channel 53 of rectangular cross-section opening upon the lower surface of the block 52 extends. The width and depth of this channel is sufficient to allow the arm 44*a* to fit smoothly and snugly therein so that the block 48 is carried upon the arm 44*a* in front of the segment 28 when the arm 44*a* is in the position as shown in FIGS. 1–3. In the present example, the sidewall 54 defines one sidewall of the hollow channel 53 through the block 52 so that the outer surface of the sidewall 54 is 1/16 closer to the centerline of the slot 26 than is the sidewall 46 of the arm 44*a*. Consequently, if the end of a board to be cut is placed against the sidewall 54 of the gauge block 48, the board will be cut to a length of 14-15/16 inches in length. Now by making the distance between the other sidewall of the hollow channel 53 in the filler block 52 and the other outer sidewall 56 15/16 inches, the gauge block 48 may be removed from the arm 44*a*, turned around 180 degrees and replaced on the arm 44*a*, so that the resulting distance between the sidewall 56 which now faces toward the slot 26 and the centerline of the slot 26 will be reduced to 14-1/16 inches. Thus, by using the gauge block 48 of the present example with the arms 44*a, b, c,* the length of a board to be cut by the blade 18 will be either 1/16 or 15/16 inches less than it would have been if one of the stop arms 44*a, b,* or *c* had been used without the gauge block 48, depending upon which way the block 48 is inserted onto the arm.

Referring now to FIGS. 6–7 and 8–9, an alternative construction for the gauge blocks of my invention are shown by blocks 58 and 60, respectively, which may be constructed on one piece molded plastic, or other suitable material. In the example shown in FIGS. 6–7, a hollow channel 62 of rectangular cross-section is formed through the length of the block 58 sufficient to permit the latter to be carried by one of the stop arms 44*a, b, c.* The distance between the outer sidewall 64 and the nearest sidewall defining the channel 62 is $\frac{1}{8}$ inch while the distance between the other sidewall defining the channel 62 and the outer sidewall 66 is $\frac{7}{8}$ inch. FIGS. 8–9 show similar construction for the gauge block 60 wherein the distance between each defining sidewall of a rectangular channel 68 and the nearest outer sidewall of the block 60 is one-half inch. The gauge block 58, therefore, permits obtaining adjustments in board lengths of either $\frac{1}{8}$ or $\frac{7}{8}$ inches while the use of the block 60 permits $\frac{1}{2}$ inch adjustments in the increments of board length otherwise obtainable using the arms 44*a, b, c* above. A complete set of gauge blocks necessary to obtain length adjustments in all 1/16 inch increments is eight in number and will provide incremental adjustments of 1/16–15/16, $\frac{1}{8}$–$\frac{7}{8}$, 3/16–13/16, $\frac{1}{4}$–$\frac{3}{4}$, 5/16–11/16, $\frac{3}{8}$–$\frac{5}{8}$, 7/16–9/16 and $\frac{1}{2}$–$\frac{1}{2}$ inches, respectively, in the one inch increments obtainable using the arms 44*a, b, c* by themselves.

Those skilled in the art will appreciate that the gauge 10 of the present example is adapted for placement on the righthand side of the blade 18 as viewed fron the front of the table 14, whereby it is referred to as a righthand gauge. A lefthand gauge of identical construction and dimensions could readily be provided for positioning to the lefthand side of the blade 18 (with the fence 16 then extending across the righthand side of the table 14 where the gauge 10 is now located), except that such a lefthand gauge would be a mirror image of the gauge 10 of the present example. Also, it will be understood that the length of the segments and the dimensions of their components are a matter of choice and could just as readily be provided for measuring and cutting boards to lengths measured in metric or other units, besides units of feet and inches and fractions thereof.

Lastly, as an alternative to the use of a plurality of individual gauge bar segments such as the segments 28, 39, 32, etc., two or more such segments could be provided as a single unitary structure of, for example, 2, 3 or more feet in length. In such a case, a single bar segment could be employed having an extra elongated rib on the end of the unit opposite the elongated rib into which the pin 42 projects. This construction would permit the pin 42 to be supported by a pair of elongated rearwardly projecting ribs at each end of the single gauge bar segment, a feature not possible using any one of the segments 28, 30, 32 of FIGS. 1–5 by themselves.

Although the present invention has been shown and described with respect to specific details of one preferred embodiment thereof, it is not intended that such details limit the scope of protection to be afforded hereby otherwise than as set forth in the following claims.

I claim:

1. A saw gauge for use with a cutoff saw of the type which includes a cutting table, an elongated fence mounted on said table, and a cutting blade adapted to cut through said fence and a board positioned on said table against said fence, said saw gauge comprising a plurality of bar segments, each of said segments being defined by a base portion adapted to mount flush upon said table in line with said fence and a plurality of raised ribs projecting upwardly from said base portion and being spaced from one another to form a plurality of open ended, U-shaped channels spaced above said table by the width of said base portion, the forward ends of said channels and ribs terminating in line with the front face of said fence, z an elongated pivot pin extending parallel to said bar segments behind and spaced from said ribs, means attached to said bar segments for supporting said pin, at least one straight, elongated stop arm pivotally connected on one end portion thereof directly to said pin and being tiltable through a vertical arc from a storage position projecting away from one of said channels with which said arc is aligned to a position of use projecting through one of said channels with which said arc is aligned and beyond the front face of said ribs, said arm being slidable along said pin for selectively aligning said arc with any one of said channels.

2. The saw gauge of claim 1 wherein said supporting means comprises at least one elongated rib on each of said segments which projects rearwardly beyond the rear ends of the remaining ones of said ribs, said rearward projecting portion of said elongated ribs defining aligned hollow shafts therethrough into which said pin projects for support of said pin at at least two different positions along its length, said arm being connected to said pin between said two different positions.

3. The saw gauge of claim 1 wherein said stop arm is constructed of aluminum material.

4. The saw gauge of claim 1 comprising a plurality of said stop arms, each of said stop arms being laterally adjustable along a portion of the length of said pin between adjacent supporting means therefor for selective alignment in any one of the channels of a different one of said bar segments.

5. The saw gauge of claim 1 further comprising gauge block means adapted for mounting on said arm to provide a measured distance between the cutting line of said blade and one side of said gauge block which is less than the measured distance between said cutting line and one side of said arm lying in one of said channels by a selected increment of distance less than the width of said arm containing channel.

6. The saw gauge of claim 5 wherein said gauge block comprises a casing of three-sided channel material having a predetermined thickness, a block of solid material disposed in said casing, said block containing a hollow channel extending therethrough adapted for sliding upon said arm, the distances between the sidewalls of said block channel and the nearest outer surfaces of said casing being precisely predetermined and less than the width of the channel defined by said segments in which said arm projects.

7. The saw gauge of claim 5 wherein said gauge block comprises a solid block of material defining a channel therethrough which is adapted to confine said arm, the distances between the sidewalls defining said block channel and the nearest outer sidewalls of said block being precisely predetermined and less than the width of a channel defined by said segments.

* * * * *